United States Patent [19]

Carr

[11] 4,225,145

[45] Sep. 30, 1980

[54] SKATEBOARD APPARATUS

[76] Inventor: Robert K. Carr, 2533 Cherokee Parkway, Louisville, Ky. 40204

[21] Appl. No.: 902,518

[22] Filed: May 3, 1978

[51] Int. Cl.[2] ..... A63C 5/00

[52] U.S. Cl. ..... 280/7.14; 280/12 H; 280/15; 280/22; 280/28; 280/87.04 A

[58] Field of Search ..... 280/16, 15, 17, 24, 280/7.13, 7.12, 12 H, 87.04 A, 87.04 R, 28, 22, 11.12, 11.15, 11.18

[56] References Cited

U.S. PATENT DOCUMENTS

| | | | |
|---|---|---|---|
| 1,546,805 | 7/1925 | St. Pierre | 280/16 |
| 2,140,976 | 12/1938 | White | 280/22 |
| 2,499,639 | 3/1950 | Forseth | 280/22 |
| 2,559,452 | 7/1951 | McLellan | 280/22 |
| 2,937,878 | 5/1960 | Reina | 280/22 |
| 4,061,350 | 12/1977 | Schmidt et al. | 280/11.28 |
| 4,114,913 | 9/1978 | Newell et al. | 280/87.04 A |
| 4,138,128 | 2/1979 | Criss | 280/87.04 A |

FOREIGN PATENT DOCUMENTS

| | | | |
|---|---|---|---|
| 538998 | 2/1956 | Italy | 280/7.13 |

*Primary Examiner*—David M. Mitchell
*Attorney, Agent, or Firm*—James Creighton Wray

[57] ABSTRACT

A modified skateboard has runners attached to existing trucks. Top and bottom rails of the runners are jointed and slotted to allow changing runner length upon turning. Mounts are slotted to accommodate varying axle base lengths of skateboard trucks and to permit shifting during turns. Right and left turns are achieved by shifting weight from side to side and shortening the runners and sliding the runners relative to the trucks. Runners are braced to keep rails perpendicular to the top of the board.

22 Claims, 14 Drawing Figures

FIG. 1
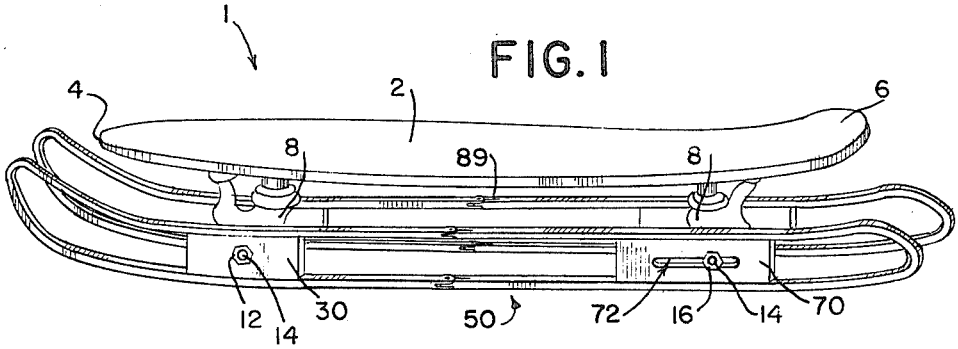
FIG. 2
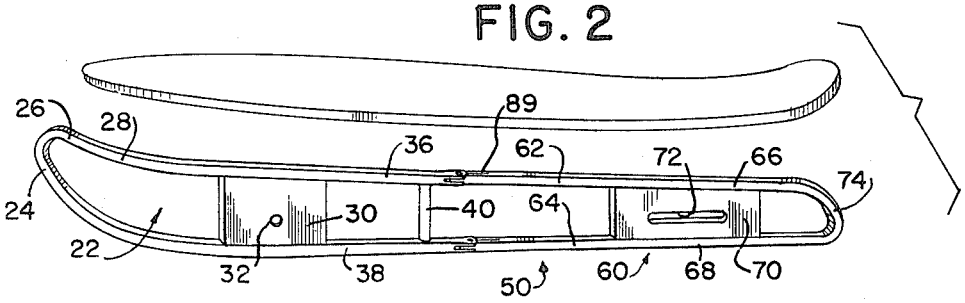
FIG. 3
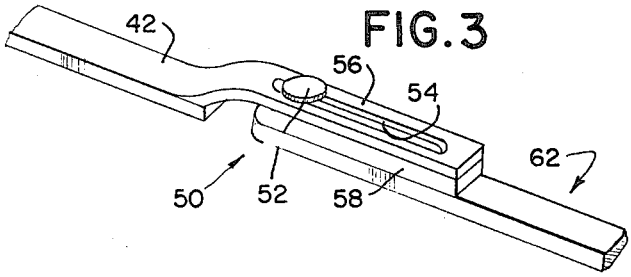
FIG. 5
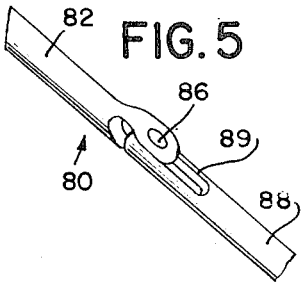
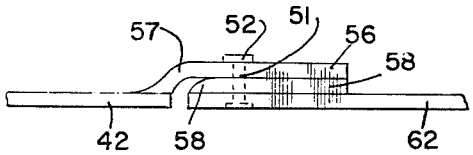
FIG. 4
FIG. 6
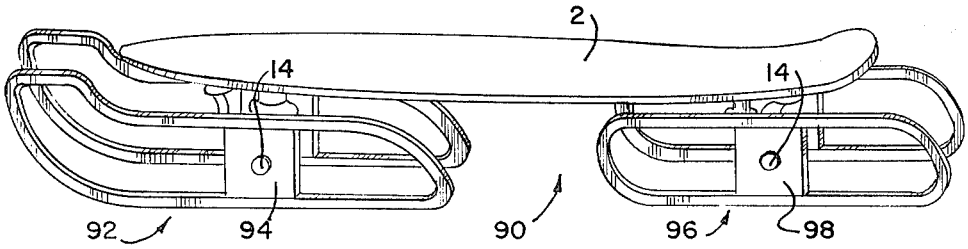

FIG. 11
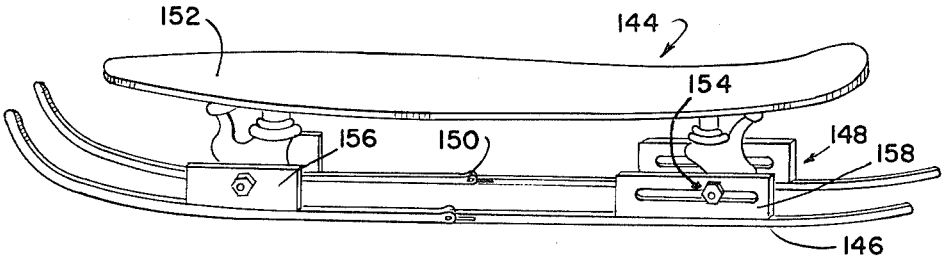
FIG. 12
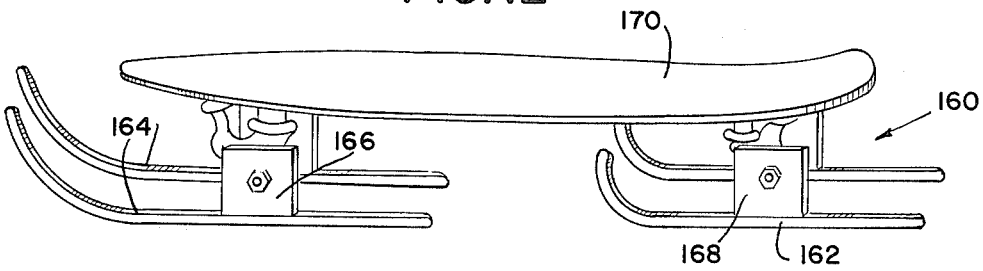
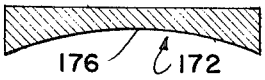
FIG. 13
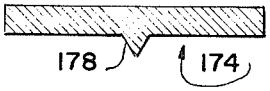
FIG. 14

SKATEBOARD APPARATUS

BACKGROUND OF THE INVENTION

1. Field of the Invention

The present invention relates generally to recreational devices for use on snow or ice. The invention relates more specifically to skateboards modified to accept pivotable sled runners mounted on skateboard trucks for guiding and turning the skateboards on snow or ice.

2. Description of the Prior Art

Pertinent United States patents are found in Class 280—Land Vehicles, subclasses 8, 9, 10, 11, 12, 11.15, 11.17, 12, 20, 21, 27, 28, 87.04A the official classifications of the United States Patent and Trademark Office.

Examples of pertinent patents are United States patents:

U.S. Pat. No. 3,583,722;

U.S. Pat. No. 4,043,565.

U.S. Pat. No. 3,583,722 shows a collapsible bobsled comprising a seating platform of forward, intermediate and rear sections hinged so that the bobsled may fold with the underside of the front and rear sections facing each other. Two bunker plates are affixed to the underside of the front and rear sections, and runners are detachably mounted on the lateral ends of the bunker plates. The detachable mounting includes mating slots and tongues with flexible pins locking the tongues in the slots. The runners are sheets of metal curved upward toward the front and curved downward with extending tongues in the rear. Runners are independently mounted on the bunker plates.

U.S. Pat. No. 4,043,565 discloses an elongated board member with runner mounting means affixed to the underside of the board with two pairs of parallel ice runners attached to the runner mounting means. The runners are triangular in shape and have a plurality of contact surfaces. A saw-toothed brake is affixed to the underside of the rear of the elongated board member.

None of the prior art discloses elongated runners that are jointed and slotted for easy turning and pivoting and lengthening and shortening. Further, none of the prior art discloses a brace to keep the elongated runners perpendicular to the skateboard. None of the prior art discloses a brace slidably mounted on the rear axle of a skateboard truck to permit attachment of runners to skateboards of varying wheelbase lengths between trucks and none shows a sliding brace which allows change in runner curvature.

SUMMARY OF THE INVENTION

The present invention is a new recreational device for use on snow or ice.

The present invention is a skateboard with elongated runners which may be described as continuous longitudinal blades similar to sled runners, mounted on the axles of skateboard trucks. The elongated runners are braced by two rectangular pieces which hold the elongated runners perpendicular to the skateboard. This provides greater stability in turning as well as strengthening the elongated runners. The elongated runners are jointed and slotted on both the upper and lower blades at approximately the midpoints of the length of the blades. This allows the elongated runners to pivot laterally to the longitudinal axis of the skateboard and allows the runners to warp about axes angularly related to the longitudinal axis. Because of the pivoting movement, the operator initiates right and left turns by shifting the operator's weight from side to side.

The elongated runners are curved upward at the front of the skateboard for easy turning. The runners are curved downward at the rear of the board to give greater stability for either straight running or turning.

The board is adapted to accept one independent runner to replace each skateboard wheel, that is a runner independently mounted on each axle of the skateboard truck. The runners are braced by rectangular pieces to keep the runners perpendicular to the skateboard. These braces are mounted on each axle of the skateboard truck and are not slotted. With each runner mounted independently, no jointed or slotted arrangement is necessary to pivot the front runners. Shifting the weight of the operator initiates all turns.

The elongated runners are adapted to accept hinge-type or coil spring joints to provide the pivoting action of the front sections of the elongated runners. This provides greater pixoting flexibility. The elongated runners are adapted to accept a ball joint arrangement to provide the pivoting action of the front section of the elongated runners. A round tube containing a spring holds a piston whose end is ball shaped. A ball joint on the rear elongated section of the runner provides the pivoting action of the front elongated runner. The piston spring arrangement provides additional length to the elongated runner to turn as the operator's needs require. Additional length is also required for the runners, when turning, on the side opposite the turn. The runners on the inside of the turn must shorten and pivot as the runners on the side opposite the turn lengthen.

The rear brace of the elongated runner mounted on the rear axle of the skateboard truck is adapted to accept a spring mounted in the slot of the brace. This allows the rear elongated section to increase its length instantaneously as the user's demands require and also retracts to its original length when additional length is not needed. The rear brace also allows instantaneous increases in length with hinge type pivoting joints connecting the front and rear elongated runner sections.

OBJECTS OF THE INVENTION

Objects of the invention are to provide a skateboard, trucks with horizontal axles affixed to an underside of the skateboard, trucks comprising forward and rearward pivoting mounts positioned in tandem to each other and near a front of the skateboard and near a rear of the skateboard, plural elongated sled runners attached to the trucks in a spaced parallel relationship and means for providing pivoting movement of said elongated runners relative to a longitudinal axis of the skateboard.

Another object of the invention is to provide elongated runners that are curved continuous longitudinal blades.

Another object of the invention is to provide elongated runners mounted on the horizontal axles of the trucks.

Another object of the invention is to provide elongated runners curved upward at the front end of the skateboard.

Another object of the invention is to provide an elongated runner curved downward at the rear end of the skateboard.

Another object of the invention is to provide elongated runners braced to keep the runners perpendicular to the bottom of the skateboard.

Another object of the invention is to provide elongated runners that are lengthened and shortened for turning as the operator's needs require.

Yet another object of the invention is to provide a rear brace mounted on the rear horizontal axle, and slotted to accommodate varying wheel base lengths between trucks.

Still another object of the invention is to provide a truck axle slidably mounted between a spring located in the slot of the rear brace.

Another object of the invention is to provide elongated runners having interengaging means for connecting the upward curved section of the runners to the downward curved section of the runners.

Another object of the invention is to provide interengaging means jointed and slotted so that the front elongated runner will pivot to turn the skateboard.

Another object of the invention is to provide interengaging means connected by a rivet slidably mounted in a slot in the rearward elongated runner.

Yet another object of the invention is to provide interengaging means connected by a bolt mounted in a hinge on both front and rear elongated runners.

Another object of the invention is to provide interengaging means connected by a spring-mounted piston connected to a ball joint in the rear elongated runner to provide pivoting movement.

Further objects of the invention are to provide a skateboard, trucks with horizontal axles affixed to the underside of the skateboard, trucks comprising forward and rearward pivoting mounts positioned in tandem to each other and near the front of the skateboard and near the rear of the skateboard, trucks including means to attach two pairs of sled runners thereto in a spaced parallel relationship and for providing pivoting movement of the forward sled runners relative to the longitudinal axis of the skateboard.

An object of the invention is to provide two pairs of runners that are curved longitudinal continuous blades.

Another object of the invention is to provide two pairs of runners mounted on the horizontal axles of the trucks. Another object of the invention is to provide a forward pair of runners curved upward at the front of the skateboard and curved downward at the middle of the skateboard.

Still another object of the invention is to provide a rearward pair of runners curved upward at the middle of the skateboard and curved downward at the end of the skateboard. A still further object of the invention is to provide two pairs of runners braced to keep the runners perpendicular to the bottom of the skateboard.

Yet another object of the invention is to provide a brace mounted on a forward pair of runners and mounted on the horizontal axle of the forward truck of the skateboard.

A still further object of the invention is to provide a brace mounted on the rearward pair of runners and mounted on the horizontal axle of the rearward truck of the skateboard.

Another object of the invention is to provide a front pair of runners independently mounted on the front horizontal axles of the trucks. A further object of the invention is to provide a rear pair of runners independently mounted on the rear horizontal axles of the trucks.

Further objects of the invention are to provide a skateboard sled having an elongated board, plural pivoting trucks attached to the board, trucks including axles mounted for pivoting about axes within the trucks at angles to a longitudinal axis of the elongated board and runners attached to the axles, and runners which warp and relatively move and curve during turning of the board.

Another object of the invention is to provide an elongated sled runner device having an elongated curved runner, a central mounting plate attached to the runner and an opening in the mounting plate for receiving a vehicle axle.

Another object of the invention is to provide an elongated runner that is a curved continuous longitudinal blade. Still another object of the invention is to provide an elongated runner curved upward at a front end.

Another object of the invention is to provide an elongated runner curved downward at a rear end. Yet another object of the invention is to provide an elongated runner braced to keep the runner perpendicular to the bottom of a vehicle. A still further object of the invention is to provide a brace slotted to accommodate varying wheel base lengths between trucks.

Another object of the invention is to provide a spring adjacent the slot wherein a truck axle is slidably mounted in the spring located in the slot of the brace. Still another object of the invention is to provide an elongated runner having plural sections with respective upward and downward curved interengaging means for connecting an upward curved section of the runner to a downward curved section of the runners.

Another object of the invention is to provide an interengaging means jointed and slotted so that the elongated runner sections pivot to turn a vehicle, while another object of the invention is to provide interengaging means connected by a rivet in the front section slidably mounted in a slot in the rearward elongated runner section.

Still another object of the invention is to provide interengaging means connected by a bolt mounted in a hinge on both front and rear elongated runner sections.

Still another object of the invention is to provide interengaging means connected by a spring-mounted piston in one section connected to a ball joint in the other elongated runner section to provide pivoting movement.

Yet another object of the invention is to provide two pairs of sled runners in spaced parallel relationship and means for providing pivoting movement of the sled runners relative to the longitudinal axis of a vehicle.

A further object of the invention is to provide two pairs of runners that are curved longitudinal continuous blades.

BRIEF DESCRIPTION OF THE DRAWINGS

FIG. 1 is a perspective view of the shateboard.

FIG. 2 is a perspective view of the skateboard and elongated runner shown in FIG. 1.

FIG. 3 is an isometric view of jointed and slotted elongated runner.

FIG. 4 is an enlarged side view of jointed and slotted elongated runner shown in FIG. 3.

FIG. 5 is a different embodiment of the slot and pin arrangement shown in FIGS. 3 and 4.

FIG. 6 is a perspective view of a different embodiment of the board.

FIG. 11 and FIG. 12 are different embodiments of FIGS. 1 and 6 respectively.

FIG. 13 and FIG. 14 are different embodiments of the surface of the elongated runner.

DETAILED DESCRIPTION OF THE DRAWINGS

Figure 7:
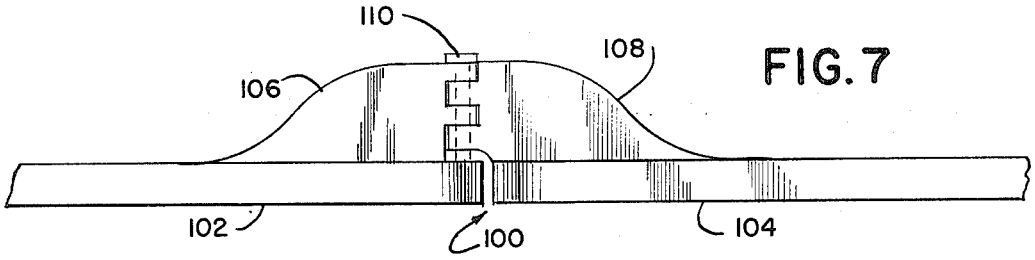
FIG. 7 is an enlarged side view of a different embodiment of the slot and pin arrangement shown in FIGS. 3 and 4.

FIG. 1 shows shateboard 1 comprising front end 4 and rear end 6 of skateboard front and rear trucks 8 for connecting elongated runners 50 to front and rear horizontal axles 14 and secured by nut 12 and 16 respectively. Front brace 30 and rear brace 70 keep elongated runners 50 perpendicular to the bottom of skateboard 2. Elongated runners 50 are connected at slot 89. Slot 89 in elongated runner 50 allows pivoting of the runners for turning. Slot 72 in rear brace 70 allows greater length of elongated runners 50 to accommodate varying wheelbase lengths of skateboard trucks.

FIG. 2 is a detailed description of elongated runner 50. Front brace 30 and rear brace 70 keep elongated runner 50 comprising: lower front blade 38, middle rear blade 64, lower rear blade 68, rear downward curve 74, rear upper blade 66, middle upper blade 62, upper front blade 36, upper upward turn 28, upper front blade tip 26 and front upward curve 24 perpendicular to bottom of skateboard shown in FIGS. 1 and 2. Front brace 30 contains horizontal axle hole 32 for connection to front skateboard truck 8 via front axle 14. Rear brace 70 contains slot 72 for connection to horizontal axle 14 of truck 8. Slot 72 accommodates varying wheelbase lengths between trucks of different skateboards. Stabilizer bar 40, perpendicular to upper and lower blades 36 and 38 respectively prevents the blades from twisting out of shape due to turns initiated by weight shift of user. A second stabilizer bar (not shown) may be added to strengthen perpendicular stiffness between the upper and lower surfaces of the runners. Pin joint 42 is slidably mounted in slot arrangement 89. Along with slot 72, pin joint 42 provides pivoting and sliding movement of the runners. Slot arrangement 89 provides changes in runner length to elongated runner 50 to accomodate varying types of turns initiated by the operator. Front upward curve 24 and front blade tip 26 of upper front blade section 28 provides easy turning of skateboard 1. Front upward curve 24 allows the runners to ride smoothly over the snow producing a floating sensation similar to the ride produced by the front upward curve of a ski. Rear downward curve 74 provides greater turn stabilization.

FIG. 3 is a detailed description of pin and joint arrangement and elongated runner 50 which allows elongated runner 50 to pivot to initiate turns. Bushing 58 mounted on elongated runner section 62 holds rivet 52 embedded in runner 50 and also gives smooth sliding action between the runner sections. The joint end of runner section 62 is rounded so that when it comes into contact with runner section 42 on turns, a smooth turn will be accomplished. The rounded end of runner section 62 relieves stress on rivet 52. Rivet 52 slides and pivots in slot 54 located on slotted rail 56. Slot 54 provides additional length to elongated runner 50.

FIG. 4 is a side view of pin and joint arrangement shown in FIG. 3. Rivet 52 with rivet stem 51 is embedded between slotted rail 56, bushing 58 and elongated runner section 62. Slotted rail 56 is connected to pin and joint arrangement by slotted rail curved extension 57.

FIG. 5 shows a separate embodiment of pin and joint arrangement. Slot and joint arrangement 80 comprises elongated runner section 82 attached to rivet pin 86 pivotably and slidably mounted in slot 89 of elongated runner section 88. Slot and joint arrangement 80 allows elongated runners 50 to pivot to initiate turns.

FIG. 6 shows a separate embodiment of skateboard 90 comprising skateboard 2 and sled runner pairs 92 and 96. Front pair of sled runners 92 is held perpendicular to skateboard 2 by brace 94. This permits easy sliding and turning by user and prevents sled board 90 from collapsing on top of the runner pairs 92 and 96. Front brace 94 is mounted on horizontal axle 14. Rear brace 98 is mounted on rear horizontal axle 14. Neither front nor rear brace is slotted in this embodiment. Braces may be added for further torsional rigidity between the upper and lower rails of the runners.

FIG. 7 shows a separate embodiment of pin and joint arrangement 42 as shown in FIGS. 3 and 4. Hinge arrangement 100 comprises elongated runner sections 102 and 104, hinges 106 and 108 mounted on elongated runner sections 102 and 104 respectively. Pin 110 connects hinge 106 and 108 on elongated runner sections 102 104. This arrangement permits easy pivoting of front and rear runners.

Figure 8:
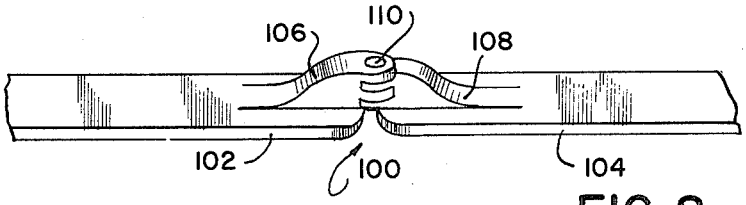
FIG. 8 is an isometric view of a different embodiment of the slot and pin arrangement shown in FIGS. 3 and 4.

FIG. 8 is an isometric view of hinge arrangement 100 as shown in FIG. 7. Hinges 106 and 108 are center-mounted on elongated runner sections 102 and 104. Pin 110 connects hinges 106 and 108.

Figure 9:
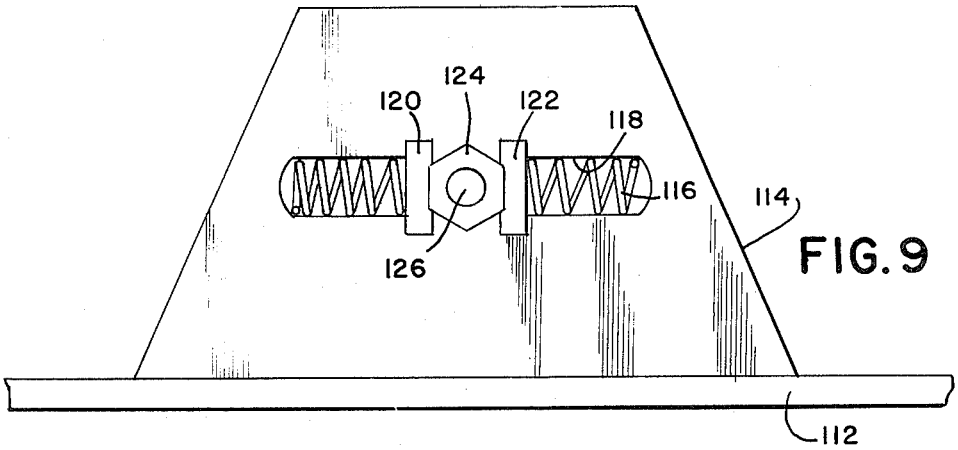
FIG. 9 is an enlarged side view of the rear brace and mounting thereof to the horizontal axle of the truck.

FIG. 9 shows an enlarged side view of rear brace 114 mounted on horizontal axle 126 and perpendicularly bracing elongated runner 112. Nut 124 is slidably mounted in slot 118. Two sliding pieces 120, 122 on opposite sides of nut 124 are held in place by the force of spring 116 mounted inside slot 118. The spring action of spring 116 permits the rear elongated runner section 112 to instantaneously adjust to pivoting motions caused by turns in the front elongated runner section. Rear elongated runner length is consequently not rigidly fixed, permitting changes in length to occur according to the stress placed upon elongated runners by user when turning.

Figure 10:
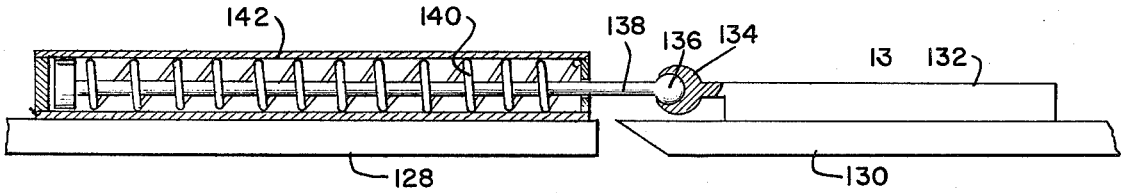
FIG. 10 is a side view of a different embodiment of the slot and pin arrangement shown in FIGS. 3 and 4.

FIG. 10 shows a separate embodiment of pin and joint arrangement as shown in FIGS. 3 and 4. Front elongated runner section 128 is connected to rear elongated runner section 130 by spring and ball-type joint 134. Closed round tube 142 and spring 140 mounted inside closed round tube 142 contain long piston 138 with ball-shaped end 136. Closed tube 142 has access through an end closest to the joint by virtue of a plug threaded into end of the tube to provide means to lubricate and replace the bushings and the spring. Ball joint 134 is mounted on bushing bar 132 on rear elongated runner section 130. Ball-shaped end 136 is mounted in ball joint 134 and is pivotable in this joint. Spring tension caused by spring 140 regulates the additional length provided by piston 138 inside closed round tube 142. The spring and ball-type joint works with the same type of runner and connection to trucks as shown in FIG. 1.

FIG. 11 shows a separate embodiment of the sled board apparatus of FIG. 1. Instead of curved continuous blades as shown in FIG. 1, upward curved blade 146 is attached to the trucks of skateboard 152 of the skateboard apparatus 144. Curved runner 146 is supported by brace 156 connected to the truck of skateboard 152. Rear brace assembly 148 comprises axle and slot 154. Slot 154 in rear brace 158 of curved runner 146 allows attachment to skateboards with varying wheelbase lengths of skateboard trucks similar to the embodiment of FIG. 1. Joint arrangement 150 is identical to the arrangement shown in FIG. 1.

FIG. 12 shows an embodiment similar to that of FIG. 6. Instead of two pairs of curved continuous blades as shown in FIG. 6, two pairs of upward curved blades are used as runners. Skateboard apparatus 160 comprises skateboard 170, front brace 166, rear brace 168, front pair of runners 164 and rear pair of runners 162. Turning skateboard apparatus 160 in this embodiment is identical to turning the skateboard shown in FIG. 6.

FIG. 13 shows the bottom surfaces of the runners. Concave surface 176 of bottom of runner 172 allows edges to grip the snow for better control. FIG. 14 shows ridge 178 of bottom runner 174 acting as a stabilizer as well as a gripper for increased traction while traveling on snow.

While the invention has been described with reference to a specific embodiment, the exact nature and scope of the invention is defined in the following claims.

What is claimed is:

1. A recreational device comprising a skateboard trucks affixed to an underside of the skateboard having horizontal axles, said trucks comprising forward and rearward pivoting mounts positioned in tandem to each other and near a front of the skateboard and near a rear of the skateboard to enable pivotal steering movement of the axles, plural elongated sled runners attached to the trucks in transversely spaced parallel front and rear pairs and means connecting the front and rear elongated sled runners on each side of the skateboard for providing a continuous runner surface and enabling lengthening and shortening of the connected runners when engaged in pivoting movement relative to a longitudinal axis of the skateboard.

2. The recreational device of claim 1 wherein the connected runners are curved continuous closed loop longitudinal blades.

3. The recreational device of claim 1 wherein the elongated runners are mounted on said horizontal axles of said trucks.

4. The recreational device in claim 1 including brace means connecting the elongated runners to the axles to keep the runners perpendicular to the axles.

5. The recreational device in claim 1 wherein the elongated runner surfaces contacting the snow are concave.

6. The recreational device in claim 1 wherein the elongated runner surfaces contacting the snow have slightly protruding ridges extending along said surfaces.

7. The recreational device of claim 4 wherein said brace means includes a front brace mounted on the front horizontal axle of the truck.

8. The recreational device of claim 4 wherein said brace means includes a rear brace mounted on the rear horizontal axle of the truck, and slotted to accomodate varying wheel base lengths between trucks.

9. The recreational device of claim 8 wherein the real horizontal truck axle is slidably mounted against a spring located in the slot of the rear brace.

10. The recreation device of claim 1 wherein the connected runners are long, narrow closed loop, metal strips curved upward at the front.

11. The recreational device of claim 1 wherein the connecting means are jointed and slotted so that the front and rear elongated runners will pivot to turn the skateboard.

12. The recreational device of claim 11 wherein the connecting means are connected by a rivet slidably mounted in a slot in the rearward elongated runner.

13. The recreational device of claim 11 wherein the connecting means are connected by a spring-mounted piston connected to a ball joint in the rear elongated runner to provide pivoting movement and lengthening and shortening of the connected front and rear runner length during pivoting movement.

14. A skateboard sled having an elongated board, plural pivoting trucks attached to the board, the trucks including axles mounted for pivoting about axes within the trucks at angles to a longitudinal axis of the elongated board and front and rear pairs of narrow, metal strip runners attached to the axles, and means for connecting the front and rear runners on each of the skateboard sled for providing a continuous runner surface and enabling the connected runners to warp and relatively move and curve and lengthen and shorten during turning of the board.

15. Elongated sled runners adapted to be attached to the trucks of a skateboard in transversely spaced parallel front and rear pairs, and means connecting the front and rear sled runners on each side of the skateboard for providing a continuous runner surface and enabling lenthening and shortening of the connected runners when engaged in pivoting movement relative to a longitudinal axis of the skateboard, and a central mounting brace attached to the runner and an opening in the mounting brace adapted for receiving a vehicle axle.

16. The device of claim 15 wherein the elongated runner is a narrow metal strip curved upward at the front end.

17. The device in claim 15 wherein said brace is in perpendicular alignment to the vehicle axle.

18. The device of claim 15 wherein said opening is a slot wherein a truck axle is adapted to be slidably mounted against a spring located in the slot of the brace.

19. The device of claim 15 wherein the connecting means are jointed and slotted so that the elongated runner sections pivot to turn a vehicle and lengthen and shorten during the pivoting movement.

20. The device of claim 19 wherein the connecting means are connected by a rivet in the front section slidably mounted in a slot in the rearward elongated runner section.

21. The device of cliam 19 wherein the connecting means are connected by a pin mounted in a hinge on both front and rear elongated runner sections.

22. The device of claim 15 wherein the connecting means are connected by a spring-mounted piston in one section connected to a ball joint in the other elongated runner section to provide pivoting movement and to provide additional length when turning and less length when on the inside of a turn.

* * * * *